US010312031B2

(12) United States Patent
Scherer

(10) Patent No.: US 10,312,031 B2
(45) Date of Patent: Jun. 4, 2019

(54) SWITCH ASSEMBLY

(71) Applicant: Fujitsu Technology Solutions Intellectual Property GmbH, München (DE)

(72) Inventor: August Scherer, München (DE)

(73) Assignee: Fujitsu Technology Solutions Intellectual Property GmbH (DE)

( * ) Notice: Subject to any disclaimer, the term of this patent is extended or adjusted under 35 U.S.C. 154(b) by 0 days.

(21) Appl. No.: 15/874,490

(22) Filed: Jan. 18, 2018

(65) Prior Publication Data

US 2018/0211800 A1 Jul. 26, 2018

(30) Foreign Application Priority Data

Jan. 20, 2017 (DE) ..... 10 2017 101 097

(51) Int. Cl.
*H01H 13/14* (2006.01)
*H01H 13/52* (2006.01)
*H01H 13/02* (2006.01)

(52) U.S. Cl.
CPC ..... *H01H 13/14* (2013.01); *H01H 13/52* (2013.01); *H01H 13/023* (2013.01); *H01H 2221/044* (2013.01); *H01H 2221/064* (2013.01); *H01H 2225/028* (2013.01); *H01H 2227/034* (2013.01); *H01H 2235/006* (2013.01); *H01H 2237/00* (2013.01)

(58) Field of Classification Search
CPC ..... H01H 13/14; H01H 13/023; H01H 13/52; H01H 2221/044; H01H 2235/006
See application file for complete search history.

(56) References Cited

U.S. PATENT DOCUMENTS 7,193,170 B2 * 3/2007 Katayama ..... H01H 13/023 200/310
2008/0053809 A1 * 3/2008 Shimazu ..... H01H 11/0018 200/530

FOREIGN PATENT DOCUMENTS

DE 2033933 A1 1/1972
DE 20 2015 102 661 U 7/2015

* cited by examiner

*Primary Examiner* — Edwin A. Leon
*Assistant Examiner* — Lheiren Mae A Caroc
(74) *Attorney, Agent, or Firm* — DLA Piper LLP (US)

(57) ABSTRACT

A switch assembly includes a manually operable push button, an elastic element, a rotatably mounted transmitter, and a microswitch, wherein the push button includes a pusher, which, upon actuation of the push button, exerts a first force on the elastic element, the elastic element connects to a force arm of the transmitter and is configured to transmit at least a part of the first force onto the force arm, and set the transmitter in a rotation, and the transmitter further includes a load arm configured to exert a second force on the microswitch during rotation of the transmitter.

17 Claims, 3 Drawing Sheets

SWITCH ASSEMBLY

TECHNICAL FIELD

This disclosure relates to a switch assembly including a manually-operable push button, an elastic element, and a microswitch.

BACKGROUND

In desktop computers, and especially in small casings, switches (on/off switch, eject button for CD ROM and the like) are frequently soldered directly onto the motherboard, and no longer guided by cable to the casing front. These switches are typically microswitches having a very short switch travel. No excessive button-pressure may be exerted in these switches since, otherwise, this can lead to damage and thus to operational failure. As the push button is typically fastened in the front panel of a computer, a long tolerance chain builds up from a pusher of the push button to the switch. The switch travel must be configured correspondingly large. However, the switch-on pressure on the microswitch can become so great in certain tolerances that the microswitch is damaged on the motherboard.

An assembly is known from DE 20 2015 102 661 U1, in which, even in an unfavorable tolerance, the risk of the damaging of the microswitch through the manually operable push button is strongly reduced or excluded. An elastic element is arranged between the manually actuatable push button and the microswitch such that, upon actuation of the manually actuatable push button, maximally the force of the elastic element acts upon the microswitch.

There is thus a need for an alternative switch assembly.

SUMMARY

I provide a switch assembly including a manually operable push button, an elastic element, a rotatably mounted transmitter, and a microswitch, wherein the push button includes a pusher, which, upon actuation of the push button, exerts a first force on the elastic element, the elastic element connects to a force arm of the transmitter and is configured to transmit at least a part of the first force onto the force arm, and set the transmitter in a rotation, and the transmitter further includes a load arm configured to exert a second force on the microswitch during rotation of the transmitter.

I also provide a switch assembly including a manually operable push button, an elastic element, a rotatably mounted transmitter, and a microswitch, wherein the push button includes a pusher, which, upon actuation of the push button, exerts a first force on the elastic element, the elastic element abuts a force arm of the transmitter and is configured to transmit at least a part of the first force onto the force arm, and set the transmitter in a rotation, and the transmitter further includes a load arm configured to exert a second force on the microswitch during rotation of the transmitter.

LIST OF REFERENCE CHARACTERS

Figure 1:
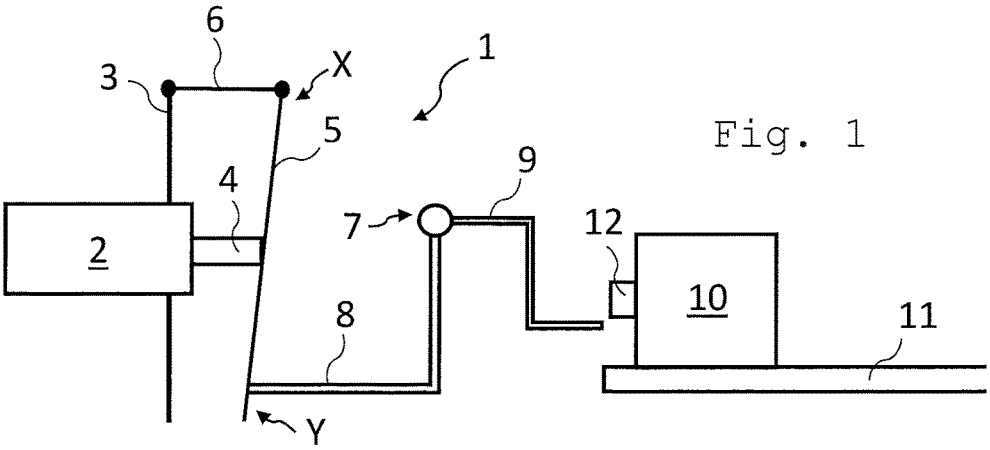
FIG. 1 shows a schematic diagram of an example of a switch assembly in a first state.

1 switch assembly
2 push button
3 chassis
4 pusher
5 spring plate
6 attaching element
7 transmitter
8 force arm
9 load arm
10 microswitch
11 circuit board
12 press-button
13 rotational axis
40 outer part of the push button
41 inner part of the push button
42 lug
43 first pin
44 second pin
45 recess
46 first bending line
47 extension
48 head
49 swing
50 LED
51 second bending line
X first end of the spring plate
Y second end of the spring plate
A first area of the attaching element
B second area of the attaching element
F1 first force
F2 second force

DETAILED DESCRIPTION

I provide a switch assembly, comprising a manually operable push button, an elastic element, and a microswitch. The switch assembly further comprises a rotatably mounted transmitter. The push button comprises a pusher, which, upon actuation of the push button, exerts a first force on the elastic element. The elastic element is connected to or abuts a force arm of the transmitter, configured to transmit at least a part of the first force onto the force arm, and set the transmitter in a rotation. The transmitter further comprises a load arm configured, during rotation of the transmitter, to exert a second force on the microswitch.

An advantage of such a switch assembly is that an increase of the first force, when a stop of the microswitch is reached, is compensated through a flexion of the elastic element, and an increase of the second force is thus prevented. A damaging or breaking off of the microswitch through action of a too great second force is avoided. An advantage of the rotatably mounted transmitter with a force arm and a load arm is that the microswitch does not have to be attached immediately behind the pusher of the push button.

The elastic element may be configured as a spring plate. An advantage in the use of a spring plate is that a spring plate is easier to produce and the elastic properties of the spring plate are adjustable corresponding to the conditions of use of the switch assembly through material and shape of the spring plate.

The load arm may be bent in at least two different directions. In this manner, the load arm can act upon the microswitch even when the microswitch is arranged offset in various directions from the push button.

The elastic element may connect at a first end to an attaching element and at a second end to the force arm of the transmitter. The pusher of the push button acts on the elastic element between the first and the second end. One advantage of this attachment is that the elastic properties of the elastic element are ideally exploited. Depending upon if the pusher of the push button acts on the elastic element closer to the first end or the second end, the possible flexion of the elastic element is influenced, and therewith the transmission of force on the microswitch is controlled.

The elastic element may have a pretensioning in the direction of the push button. This has the advantage that the elastic element restores the push button to an initial state upon actuation of the push button. Furthermore, it is ensured that no gap can occur between the pusher of the push button and the elastic element.

The switch assembly is particularly suitable for use in a computer system, wherein the push button is arranged on a chassis, in particular a front panel of the computer system.

The switch assembly may further include a light source, in particular an LED. The force arm and the transmitter are configured as a light guide. If the push button also has a light guide element, light emitted from the light source will be transmitted to the light guiding element of the push button through the force arm, and the push button is illuminated. Thus, it can be indicated to a user whether a device, in which the switch assembly is installed, is turned on or off.

Further advantageous constructions are disclosed in the following descriptions of selected examples. The examples are described based upon the appended figures. In the figures, similar reference characters are used for elements with substantially similar functions, these elements do not, however, have to be identical in every detail.

FIG. 1 shows a switch assembly 1 in a first state. The switch assembly 1 includes a manually operable push button 2 arranged on a chassis 3 of an electronic device, for example, a computer system. In the first state, the push button 2 is in an initial state. The push button 2 is not depressed and lies substantially outside of the chassis 3. Further arrangements of the push button 2 are of course possible.

The push button 2 comprises a pusher 4 on an end lying within the chassis 3. The pusher 4 of the push button 2 abuts a spring plate 5. The spring plate 5 connects at a first end X to the chassis 3 though an attaching element 6. On the side of the spring plate 5 facing away from the pusher 4, the switch assembly 1 comprises a rotatably mounted transmitter 7. A force arm 8 and a load arm 9 are mounted on the transmitter 7. The force arm 8 of the transmitter 7 abuts a second end Y of the spring plate 5. The switch assembly 1 further includes a microswitch 10 arranged on a circuit board 11, and in particular soldered to it. The load arm 9 of the transmitter 7 is configured so that it ends at a short distance from before a press-button 12 of the microswitch 10.

Figure 2:
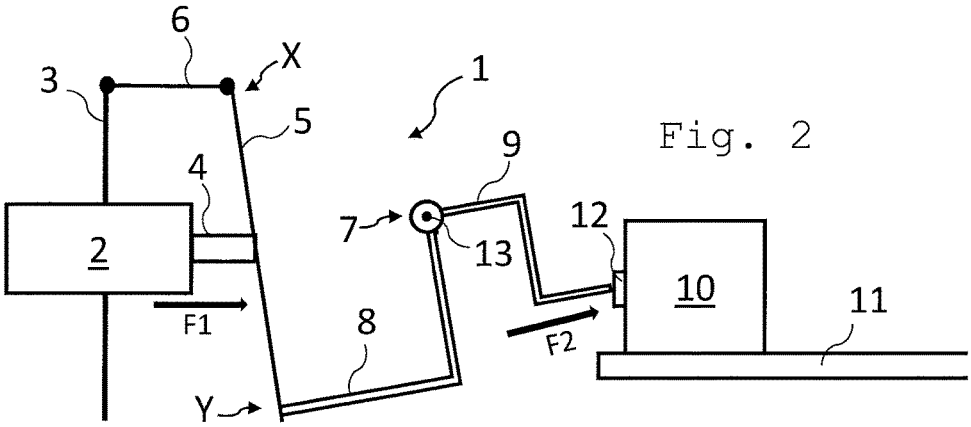
FIG. 2 shows a schematic diagram of the switch assembly from FIG. 1 in a second state.

In FIG. 2, the switch assembly 1 is in a second state. In this state, the push button 2 is approximately half-depressed. The push button 2 transmits a first force F1 linearly via a pusher 4 onto the spring plate 5. The second end Y of the spring plate 5 is displaced in the direction of the first force F1. Through the displacement of the spring plate 5, at least a part of the first force F1 is transmitted onto the force arm 8 of the transmitter 7. This places the transmitter 7 in a rotational movement around a rotational axis 13.

Rotation of the transmitter 7 causes a movement of the load arm 9 on a circular path. The circular path of the load arm 9 extends such that a free-standing end of the load arm 9 acts on the press-button 12 of the microswitch 10. The load arm 9 exerts a second force F2 on the press-button 12. The press-button 12 of the microswitch 10 has a significantly smaller switch travel than the push button 2, and is arranged so that the direction in which the press-button 12 is depressed is the same as the one in which the push button 2 is moved. The press-button 12 has already reached a stop in this state.

Figure 3:
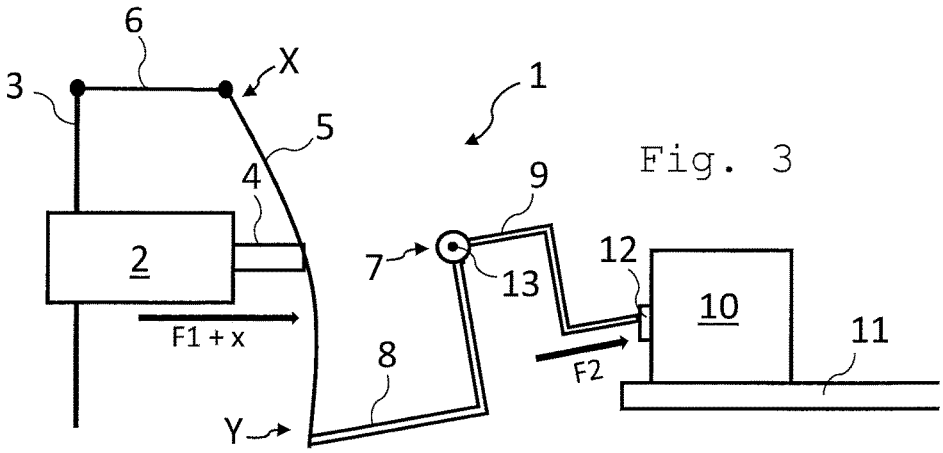
FIG. 3 shows a schematic diagram of the switch assembly from FIG. 1 in a third state.

FIG. 3 shows a third state of the switch assembly 1 from FIG. 1. In this state, the push button 2 is nearly completely depressed. The first force F1, which the push button 2 transmits to the spring plate 5 through the pusher 4, is further increased relative to the second state from FIG. 2.

Transmission of the further increase of the first force F1 compared to FIG. 2 onto the microswitch 10 could damage the microswitch 10 or break it off from the circuit board 11. To avoid this, the spring plate 5, in the third state, experiences an elastic flexion. This flexion compensates for the excess portion of the first force F1, which could lead to a damaging of the microswitch 10.

Figure 4:
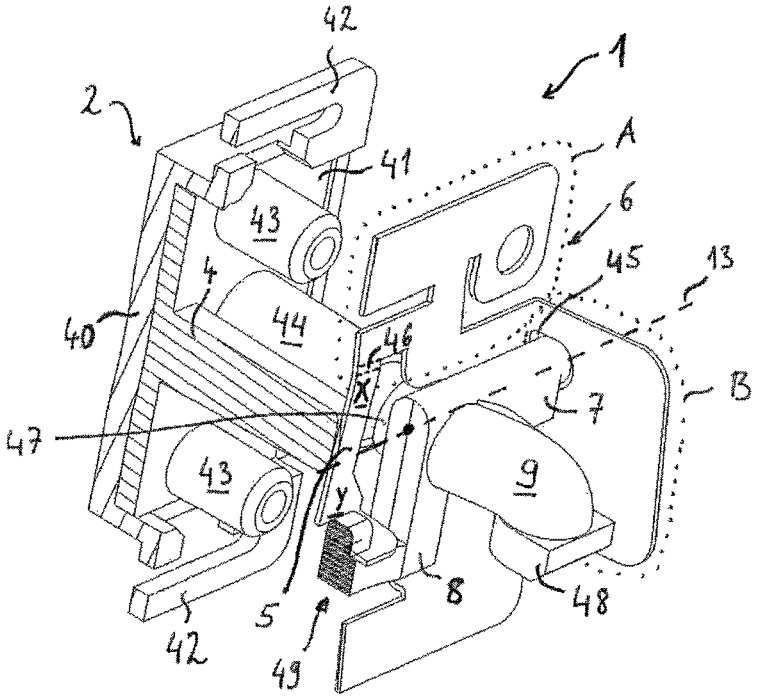
FIG. 4 shows a perspective cross-sectional view of the switch assembly according to a further example.

FIG. 4 shows a perspective cross-sectional view of a switch assembly 1 according to a further example. The diagram shows a push button 2 comprising an outer part 40 and an inner part 41. The outer part 40 is, upon actuation of the push button 2, for example, touched by a user. The outer part 40 comprises in each case one elastic lug 42 on two opposite lateral edges. The push button 2 is fastened to a chassis by the lugs 42 so that, during a pressing-in operation of the push button 2, a return force is built up by the lugs 42, which restores the push button 2 back in an initial position after an actuation.

The inner part 41 of the push button 2 is securely connected to the outer part 40, and comprises a pusher 4. This pusher 4 is attached mid-way between the lateral edges with the lugs 42 and laterally offset with respect to a center of the push button 2. The pusher 4 lies in a sectional plane of FIG. 4, and is perpendicularly on a surface of the inner part 41 of the push button 2. The inner part 41 furthermore comprises two first pins 43. The first pins 43 are used to guide a chassis in, in particular a front panel of a computer system, in which the switch assembly 1 is installed. These first pins 43 likewise stand perpendicularly on the surface of the inner part 41, but are only approximately half as long as the pusher 4. Furthermore, the inner part 41 comprises a second pin 44.

The second pin 44 is arranged in the center of the push button 2, and stands perpendicularly on the surface of the inner part 41. The spatial arrangement of the first pins 43, the second pin 44, and the pusher 4 on the inner part 41 can certainly vary in an appropriate manner.

FIG. 4 further shows a spring plate 5 and an attaching element 6. In this example, spring plate 5 and attaching element 6 are two parts of a contiguous component produced in one piece. The attaching element 6 comprises two areas A and B. The first area A serves for fastening to the chassis. The second area B comprises two recesses 45 for rotatably mounting a transmitter 7, of which only one is seen in FIG. 4. A connecting line between the recesses 45 corresponds to the rotational axis 13 of the transmitter 7.

The area A is arranged parallel to the surfaces of the two parts 40, 41 of the push button 2. The area B stands perpendicularly on the area A, and lies on a side of the area A opposite the push button 2.

Approximately midway between a first end X and a second end Y of the spring plate 5, the pusher 4 abuts on the spring plate 5. The spring plate 5 connects to the attaching element 6 on the first end X, and is angled at this point on a first bending line 46 by a few degrees relative to area A in the direction of the push button 2. This bending generates a return force in the direction of the push button 2, which presses the push button 2 in its initial position after the actuation, and ensures that a coherent contact exists between the spring plate 5 and the pusher 4, even where there are tolerances in the switch assembly 1.

On the second end Y, the spring plate 5 is attached to the transmitter 7. The first end X of the spring plate 5 is arranged at approximately the height of the rotational axis 13. The transmitter 7 comprises a force arm 8 in the area of the spring plate 5 configured as a swing 49 with a rigid suspension. Attachment of the second end Y of the spring plate 5 on the force arm 8 of the transmitter 7 is located in the lowest point of the swing 49.

The transmitter 7 also comprises a load arm 9. This is attached next to the swing 49, at approximately the height of the rotational axis 13 to the transmitter 7, and stands at a 90° angle to the force arm 8. The load arm 9 is bent in two directions so that its shape corresponds to the beginning of a spiral. At a free-standing end, the load arm 9 comprises a head 48. The load arm 9 points away from the push button 2 and has a similar diameter as the second pin 44. On the side of the transmitter 7 facing the push button 2, a short extension 47 of the load arm 9 is attached at the height of the load arm 9. Load arm 9 and extension 47 are attached to the transmitter 7 such that the extension 47 is arranged at the end face opposite to the second pin 44. Between second pin 44 and extension 47 is a sufficiently large distance so that the two elements 44, 47 do not touch each other during a rotation of the transmitter 7. Load arm 9, head 48, extension 47, transmitter 7, second pin 44, and the inner part 41 of the push button 2 are made of light-conducting material. The outer part 40 of the push button 2 consists of an opaque material.

Figure 5:
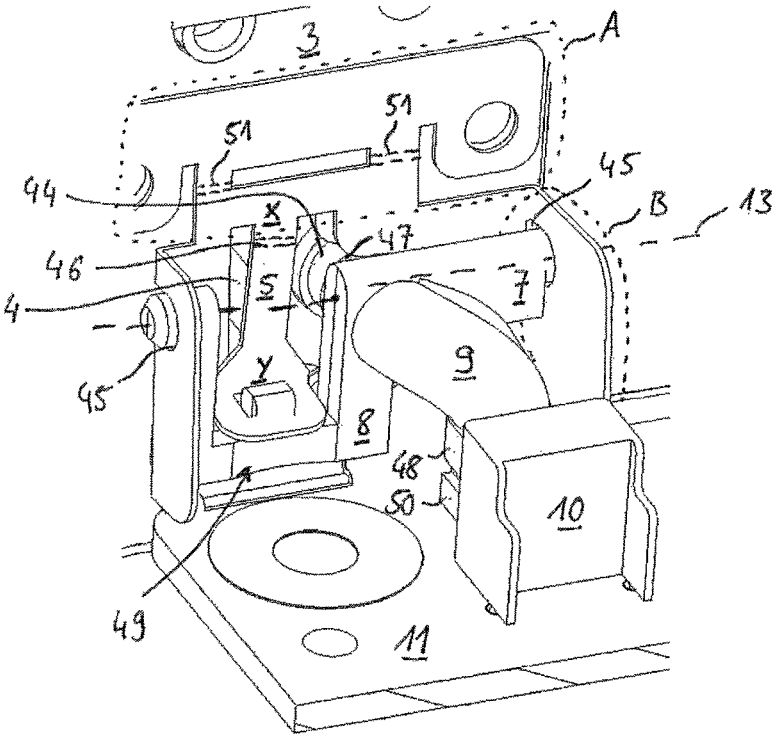
FIG. 5 shows a further perspective view of the switch assembly from FIG. 4.

FIG. 5, in addition to the elements from FIG. 4, shows a part of a chassis 3, a circuit board 11, and a microswitch 10. The microswitch 10 is soldered to the circuit board 11. The microswitch 10 comprises a press-button that cannot be discerned in this representation. The press-button is attached to the microswitch 10 such that the head 48 touches the press-button during a rotation of the transmitter 7, and actuates this press-button.

If the push button 2 visible in FIG. 4 is touched, then a switching state of the microswitch 10, as described in the FIGS. 1 to 3, is altered. Through bending of the spring plate 5, an excess of a first force F1 is compensated for, when the press-button is already depressed, and a further increase of a second force F2 would damage the microswitch 10. The head 48 comprises an inclined surface arranged so that it encounters flatly on the press-button of the microswitch 10 during the rotational movement of the head 48.

In FIG. 5, it can be seen that the spiral-shaped configuration of the load arm 9 makes possible an enacting of the load arm 9 on the microswitch 10, although the microswitch 10 does not lie linearly behind the pusher 4 of the push button 2, but rather additionally is arranged offset in two further directions. Through suitable configurations of the load arm 9, in virtually all desired arrangements of the microswitch 10, functionality of the switch assembly 1 can be ensured.

Furthermore, in FIG. 5, an LED 50 soldered onto the circuit board 11 is shown. The LED 50 is arranged in front of the microswitch 10 below the head 48 and radiates from the circuit board 11 in a perpendicular manner. The LED 50 generates, for example, when the computer is turned on, a light carried by the light-conducting material of the head 48, the force arm 9, the transmitter 7, the extension 47, the second pin 44 up until the inner part 41 of the push button 2. In the outer part 40 of the push button 2, a cutout is present, for example, in the form of a power logo through which the light of the LED 50 is visible. The assembly 1 offers in front of the microswitch 10 enough space on the circuit board 11 for the LED 50. The force arm 9 is configured such that it can actuate the push button of the microswitch 10, as well as be used as light guide for the light radiated by the LED.

Additionally, in FIG. 5, a second bending line 51 in the area A of the attaching element 6 can be seen. On this second bending line 51, a lower part of the attaching element 6 in which the area B and the spring plate 5 are arranged, is angled by a few degrees in the direction of the circuit board 11. If, in assembling the computer system, the area A is attached to the chassis 3, and the circuit board 11 is then inserted in the chassis 3, then the circuit board 11 pushes the lower part of the attaching element 6, together with the spring plate 5 and the area B into a desired position. This ensures that the circuit board 11 and the attaching element 6 terminate flush, and thereby the head 48 of the force arm 9 is located in a predefined distance in front of the microswitch 10.

Figure 6:
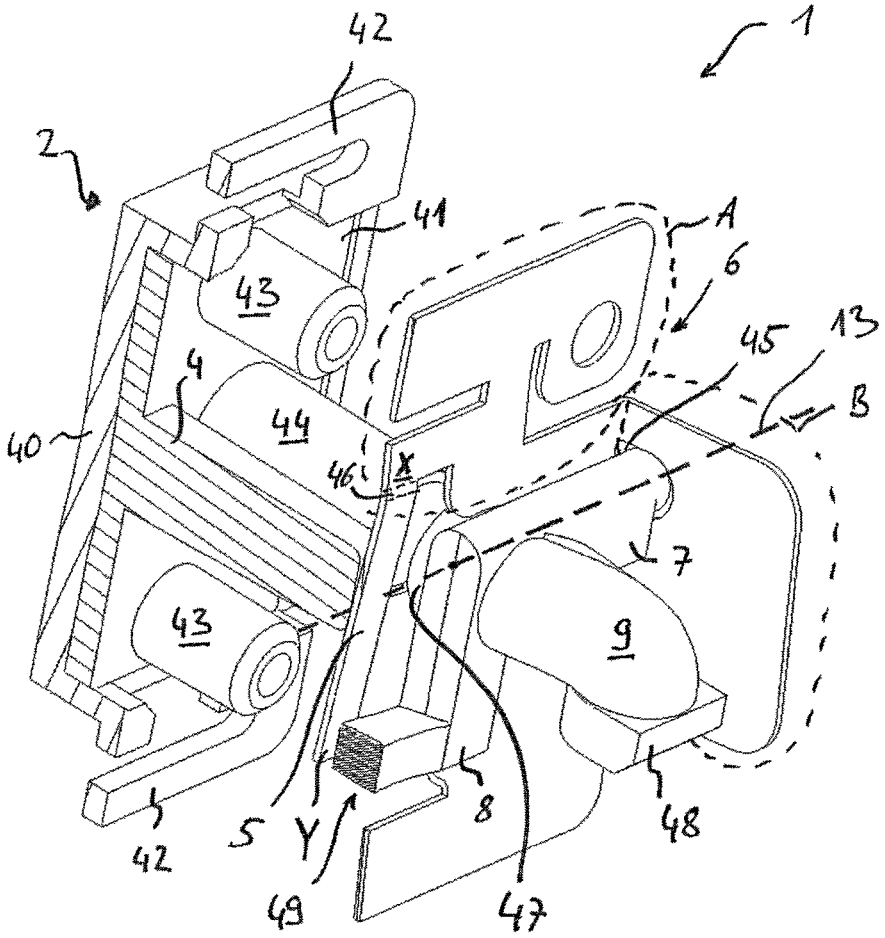
FIG. 6 shows a perspective cross-sectional view of the switch assembly according to a further example.

FIG. 6 shows a perspective cross-sectional view of a switch assembly 1 according to a further example. A push button 2 of the switch assembly 1 is the same as the push button 2 of the switch assembly of the example according to FIG. 4.

FIG. 6 shows a spring plate 5 and an attaching element 6. Arrangement, configuration and function of the attaching element 6 is the same as the example according to FIG. 4.

Approximately midway between a first end X and a second end Y of the spring plate 5, the pusher 4 abuts on the spring plate 5. The spring plate 5 connects to the attaching element 6 on the first end X, and is angled at this point on a first bending line 46 by a few degrees relative to area A in the direction of the push button 2. This bending generates a return force in the direction of the push button 2, which presses the push button 2 in its initial position after an actuation, and ensures that a coherent contact exists between the spring plate 5 and the pusher 4, even where there are tolerances in the switch assembly 1. Parts of the spring plate 5 may also contact a corresponding part of an outer enclosure (not shown in FIG. 6) to limit the bending of the spring plate 5 in an outward direction.

On the second end Y, the spring plate 5 abuts the transmitter 7, at least when the push button 2 is depressed. The first end X of the spring plate 5 is arranged at approximately the height of the rotational axis 13. The transmitter 7 comprises a force arm 8 in the area of the spring plate 5, which is configured as a swing 49 with a rigid suspension. The second end Y of the spring plate 5 abuts the force arm 8 of the transmitter 7 in the lowest point of the swing 49. The transmitter 7 also comprises a load arm 9. Arrangement, configuration and function of the load arm 9 in this example is the same as the example according to FIG. 4.

In this example, the spring plate 5 is not fixedly attached to the transmitter 7, but touches the force arm 8 of the transmitter 7 or is separated from it by a small air gap in an initial state. When the push button 2 is depressed, the first force F1 is transmitted onto the spring plate 5, which then abuts and pushes against the force arm 8 of the transmitter 7. This way, actuation of the switch assembly 1 is performed the same as an actuation of the switch assembly according to FIG. 4.

When the push button 2 is released and its initial position is restored, in this example, the spring plate 5 does not pull the transmitter 7 back into the transmitter's 7 initial position. The weight of the transmitter 7, in particular of the force arm 8 and of the load arm 9, suffices to move the transmitter 7 back to its initial position.

Although my assemblies have been described in connection with specific forms thereof, it will be appreciated that a wide variety of equivalents may be substituted for the specified elements described herein without departing from the spirit and scope of this disclosure as described in the appended claims.

What is claimed is:

1. A switch assembly comprising a manually operable push button, an elastic element, a rotatably mounted transmitter, and a microswitch, wherein the push button comprises a pusher, which, upon actuation of the push button, exerts a first force on the elastic element, the elastic element connects to a force arm of the transmitter and is configured to transmit at least a part of the first force onto the force arm, and set the transmitter in a rotation, and the transmitter further comprises a load arm configured to exert a second force on the microswitch during rotation of the transmitter, wherein an increase of the first force is compensated for through bending of the elastic element, and an increase of the second force is prevented through the bending of the elastic element when a stop of the microswitch is reached.

2. The switch assembly according to claim 1, wherein the microswitch is arranged laterally offset from the pusher of the push button.

3. The switch assembly according to claim 1, wherein the elastic element is configured as a spring plate.

4. The switch assembly according to claim 1, wherein the force arm and the load arm are arranged to be offset from one another on the transmitter.

5. The switch assembly according to claim 4, wherein the offset is 90°.

6. The switch assembly according to claim 1, wherein the load arm is bent in at least two different directions.

7. The switch assembly according to claim 1, wherein the elastic element is connected at a first end of the elastic element with an attaching element and at a second end of the elastic element with the force arm of the transmitter, and the pusher of the push button acts on the elastic element between the first and the second end.

8. The switch assembly according to claim 1, wherein the elastic element has a pretension in direction of the push button.

9. The switch assembly according to claim 1, further comprising a chassis of a computer system, wherein the switch assembly provides an on/off-switch mechanism for a computer system, and the push button is arranged on the chassis of the computer system.

10. The switch assembly according to claim 1, further comprising an LED light source and the load arm and the transmitter are configured as a light guide.

11. The switch assembly according to claim 10, wherein the push button comprises at least one light guide element and light emitted from the light source is transmitted onto the light guide element of the push button via the load arm, and illuminates the push button.

12. The switch assembly according to claim 1, wherein the pusher of the push button abuts the elastic element.

13. The switch assembly according to claim 1, wherein the pusher of the push button, upon actuation of the push button, acts on the elastic element.

14. A switch assembly comprising a manually operable push button, an elastic element, a rotatably mounted transmitter, and a microswitch, wherein the push button comprises a pusher, which, upon actuation of the push button, exerts a first force on the elastic element, the elastic element abuts a force arm of the transmitter and is configured to transmit at least a part of the first force onto the force arm, and set the transmitter in a rotation, and the transmitter further comprises a load arm configured to exert a second force on the microswitch during rotation of the transmitter, wherein an increase of the first force is compensated for through bending of the elastic element, and an increase of the second force is prevented through the bending of the elastic element when a stop of the microswitch is reached.

15. The switch assembly according to claim 14, wherein the force arm and the load arm have a weight distribution such that a weight of the force arm and the load arm is arranged to move the transmitter back to its initial position after an actuation of the push button.

16. The switch assembly according to claim 14, wherein the pusher of the push button abuts the elastic element.

17. The switch assembly according to claim 14, wherein the pusher of the push button, upon actuation of the push button, acts on the elastic element.

* * * * *